US007441597B2

(12) United States Patent
Kasevich

(10) Patent No.: US 7,441,597 B2
(45) Date of Patent: Oct. 28, 2008

(54) METHOD AND APPARATUS FOR IN-SITU RADIOFREQUENCY ASSISTED GRAVITY DRAINAGE OF OIL (RAGD)

(75) Inventor: Raymond S. Kasevich, Mt. Washington, MA (US)

(73) Assignee: KSN Energies, LLC, Great Barrington, MA (US)

( * ) Notice: Subject to any disclaimer, the term of this patent is extended or adjusted under 35 U.S.C. 154(b) by 0 days.

(21) Appl. No.: 11/471,276

(22) Filed: Jun. 20, 2006

(65) Prior Publication Data

US 2006/0283598 A1 Dec. 21, 2006

Related U.S. Application Data

(60) Provisional application No. 60/692,112, filed on Jun. 20, 2005.

(51) Int. Cl.
*E21B 43/24* (2006.01)

(52) U.S. Cl. ..... 166/247; 166/248; 166/272.1; 166/302; 166/369

(58) Field of Classification Search ..... None
See application file for complete search history.

(56) References Cited

U.S. PATENT DOCUMENTS

| | | | | |
|---|---|---|---|---|
| 2,757,738 | A * | 8/1956 | Ritchey | 166/248 |
| 3,522,848 | A | 8/1970 | New | |
| 4,008,762 | A | 2/1977 | Fisher | |
| 4,470,459 | A | 9/1984 | Copland | |
| 5,082,054 | A | 1/1992 | Kiamanesh | |
| 6,189,611 | B1 * | 2/2001 | Kasevich | 166/248 |

FOREIGN PATENT DOCUMENTS

| | | |
|---|---|---|
| WO | WO 99/30002 | 6/1999 |
| WO | WO 00/57021 | 9/2000 |

* cited by examiner

*Primary Examiner*—Zakiya W. Bates
(74) *Attorney, Agent, or Firm*—Dorsey & Whitney LLP

(57) ABSTRACT

The present invention relates generally to the use of radiofrequency energy to heat heavy crude oil or both heavy crude oil and subsurface water in situ, thereby enhancing the recovery and handling of such oil. The present invention further relates to methods for applying radiofrequency energy to heavy oils in the reservoir to promote in situ upgrading to facilitate recovery. This invention also relates to systems to apply radiofrequency energy to heavy oils in situ.

29 Claims, 4 Drawing Sheets

METHOD AND APPARATUS FOR IN-SITU RADIOFREQUENCY ASSISTED GRAVITY DRAINAGE OF OIL (RAGD)

CROSS-REFERENCE TO RELATED APPLICATION(S)

This application claims priority from U.S. provisional patent application No. 60/692,112, which was filed on Jun. 20, 2005, and which is incorporated herein by reference in its entirety.

FIELD OF THE INVENTION

The present invention relates generally to the use of radiofrequency energy to heat heavy crude oil or both heavy crude oil and subsurface water in situ, thereby enhancing the recovery and handling of such oil. The present invention further relates to methods for applying radiofrequency energy to heavy oils in the reservoir to promote in situ upgrading to facilitate recovery. This invention also relates to systems to apply radiofrequency energy to heavy oils in situ.

BACKGROUND OF THE INVENTION

Heavy crude oil presents problems in oil recovery and production. Crude oils of low API gravity and crude oils having a high pour point present production problems both in and out of the reservoir. Extracting and refining such oils is difficult and expensive. In particular, it is difficult to pump heavy crude oil or move it via pipelines.

Recovery of heavy crude oils may be enhanced by hearing the oil in situ to reduce its viscosity and assist in its movement. The most commonly used process today for enhanced oil recovery is steam injection, where the steam condensation increases the oil temperature and reduces its viscosity. Steam in the temperature range of 150 to 300 degrees Celsius may decrease the heavy oil viscosity by several orders of magnitude. Cyclic steam simulation (CCS) is a method that consists of injecting steam into a well for a period of time and then returning the well to production. A recently developed commercial process for heavy oil recovery is steam assisted gravity drainage (SAGD), which finds its use in high permeability reservoirs such as those encountered in the oil sands of Western Canada. SAGD has resulted recovery of up to 65% of the original oil in places, but requires water processing. All such methods tend to be expensive and require the use of external water sources.

Other methods in current use do not require the use of water or steam. For example, processes such as the Vapex process, which uses propane gas, and naphtha assisted gravity drainage (NAGD) use solvents to assist in the recovery of heavy crude oils. The drawback to these processes is that the solvents—propane or naphtha—are high value products and must be fully recovered at the end of the process for it to be economical.

Yet another potential method to enhance the recovery of heavy crude oils is the Toe-To-Heel Injection (THAI) process proposed by the University of Bath. THAI involves both vertical wells and a pair of horizontal wells similar to that used in the SAGD configuration, and uses combustion as the thermal source. Thermal cracking of heavy oil in the porous media is realized, and the high temperature in the mobile oil zone provides efficient thermal sweeping of the lighter oil to the production well.

Even when they are recovered, heavy crude oils present problems in refinement. Heavy and light crude oil processing will give the same range of refined products but in very different proportions and quantities. Heavy oils give much more vacuum residues than lighter oils. These residues have an API between one and five and very high sulfur and metals content, which makes treatment difficult. Several processes exist to convert vacuum residues. They are thermal, catalytic, chemical, or combinations of these methods. Thermal processes include visbreaking, aquathermolysis and coking.

Solvent deasphalting (SDA) is a proven process which separates vacuum residues into low metal/carbon deasphalted oil and a heavy pitch containing most of the contaminants, especially metals. Various types of hydrotreating processes have been developed as well. The principle is to lower the carbon to hydrogen ratio by adding hydrogen, catalysis such as tetralin. The goal is to desulfurize and remove nitrogen and heavy metals. These processes may require temperature control, pressure control, and some form of reactor technology such as fixed bed, ebullated bed, or slurry reactor.

Recent concepts associate different processes to optimize the heavy crude conversion. For example, the combination of hydrotreating and solvent deasphalting in refineries or on site for partial upgrading of heavy crude may be used.

Finally, the process of gasification for upgrading heavy oil is used. It consists of conversion by partial oxidation of feed, liquid, or solid into synthesis gas in which the major components are hydrogen and carbon monoxide.

There is a need for an apparatus and method to enhance the recovery of heavy crude oils that does not suffer from the drawbacks associated with current methods. In particular, there is a need for a method that does not use steam or water from external sources, solvents that must be recovered, or combustion. Ideally, such an apparatus and method would at the same time assist in the in situ refinement of the heavy oil.

The present invention provides just such a method and apparatus. It utilizes radiofrequency energy to combine enhanced oil recovery with physical upgrading of the heavy oil.

BRIEF SUMMARY OF THE INVENTION

The present invention provides a system and method to apply radiofrequency energy to in-situ heavy crude oil to heat the oil and other materials in its vicinity. This system and method enhance the recovery of the heavy crude oil. At the same time, it may be used to upgrade the heavy crude oil in situ.

This system enhances the recovery of oil through a thermal method. Heavy crude oils have high viscosities and pour points, making them difficult to recover and transport. Heating the oil, however, lowers the viscosity, pour point, and specific gravity of the oil, rendering it easier to recover and handle. Thus, in the present invention, directed radiofrequency radiation and absorption are used to heat heavy oil and reduce its viscosity, thus enhancing recovery. This dielectric heating also tends to generate fissures and controlled fracture zones in the formation for enhanced permeability and improved flow recovery of fluids and gases.

The system of the present invention is an in-situ radiofrequency reactor (RFR) to apply radiofrequency energy to heavy crude oil in situ. The RFR incorporates an in-situ configuration of horizontal and vertical wells in a heavy crude oil field. Using these wells, the RFR creates a subterranean reactor for the optimum production and surface recovery of the heavy crude oil. The RFR will provide an oil/hydrocarbon vapor front that will optimize recovery of the oil.

In it simplest form, the RFR may consist of two wells in the oil field, one a radiofrequency well and the second an oil/gas producing well. At least a portion of both wells are horizontal in the oil field, and the horizontal portion of the radiofrequency well is above the horizontal portion of the oil/gas producing well. A radiofrequency transmission line and antenna are placed in the horizontal radiofrequency well and used to apply radiofrequency energy to the oil, thereby heating it. The resulting reduction in the viscosity of the oil and mild cracking of the oil causes the oil to drain due to gravity. It is then recovered through the horizontal oil/gas producing well. Naturally, any number of radiofrequency and oil/gas producing wells can be used to create an RFR for the recovery of heavy crude oils.

The invention also has the capability of further enhancing recovery through the directed upgrading of the heavy oil in situ. The horizontal radiofrequency well may be strongly electromagnetically coupled to the horizontal oil/gas producing well so that the temperature of the horizontal oil/gas producing well may be precisely controlled, thereby allowing for upgrading of the heavy oil in the producing well over a wide range of temperatures. The oil/gas producing well may be embedded in a fixed bed of material, such as a catalyst bed, selected to provide upgrading of the crude oil draining from above. The upgrading can be based on several different known technologies, such as visbreaking, coking, aquathermolysis, or catalytic bed reactor technology.

The present invention has several promising advantages over present methods used to enhance recovery of heavy oil. In particular, the RFR does not require the use of water from external sources. This reduces expense and makes the recovery more economical and efficient. Furthermore, the present invention does not require the use of expensive solvents. Through the use of the present invention, enhanced recovery of heavy crude oil can be achieved more efficiently and cost-effectively.

Furthermore, in situ processing of crude oil has several advantages over conventional oil surface upgrading technology. First, in situ upgrading can be applied on a well to well basis, so that large volumes of production needed for surface processes are not required. Large, costly pressure vessels are not required since the reservoir formation serves as a reactor vessel. It can be applied in remote locations where a surface refinery would be inappropriate. Some of the required gases and possibly water can be generated in situ by the radiofrequency energy absorption. Finally, full range whole crude oils are treated by RFR and not specific boiling range fractions as is commonly done in refineries. This is made possible by the ability of radiofrequency absorption to provide precise temperature control throughout the reactor volume. The proposed reactor provides large quantities of heat through radiofrequency absorption close to the production well where the catalyst bed is placed. No heat carrying fluids are necessary with radiofrequency heating.

In one embodiment of the invention, an in situ radiofrequency reactor for use in thermally recovering oil and related materials may be provided. The reactor may comprise at least one radiofrequency heating well in an area in which crude oil exists in the ground, a radiofrequency antenna positioned within each radiofrequency heating well in the vicinity of the crude oil, a cable attached to each radiofrequency antenna to supply radiofrequency energy to such radiofrequency antenna, a radiofrequency generator attached to the cables to generate radiofrequency energy to be supplied to each radiofrequency antenna, and at least one production well in proximity to and below the radiofrequency wells for the collection and recovery of crude oil.

In another embodiment of the invention, an in situ radiofrequency reactor for use in thermally recovering oil and related materials and refining heavy crude oil in situ may be provided. The reactor may comprise at least one radiofrequency heating well in an area in which crude oil exists in the ground, a radiofrequency antenna positioned within each radiofrequency heating well in the vicinity of the crude oil, a cable attached to each radiofrequency antenna to supply radiofrequency energy to such radiofrequency antenna, a radiofrequency generator attached to the cables to generate radiofrequency energy to be supplied to each radiofrequency antenna, at least one production well in proximity to and below the radiofrequency wells and coupled magnetically to the radiofrequency wells for the collection and recovery of crude oil, and at least one catalytic bed in which the production well is embedded.

In yet another embodiment of the invention, a method for recovering heavy crude oil is provided. The method comprises the steps of positioning a radiofrequency antenna in a well in the vicinity of heavy crude oil, generating radiofrequency energy, applying the radiofrequency energy to the heavy crude oil with the radiofrequency antenna to heat the oil, and recovering the heavy crude oil through production well.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

A variety of different arrangements of wells and antennae may be employed to apply radiofrequency energy to heavy crude oil in situ, thereby enhancing oil recovery and achieving in situ upgrading of the oil. The proper structure and arrangement for any particular application depends on a variety of factors, including size of field, depth, uniformity, and nature and amount of water and gases in the field.

Figure 1:
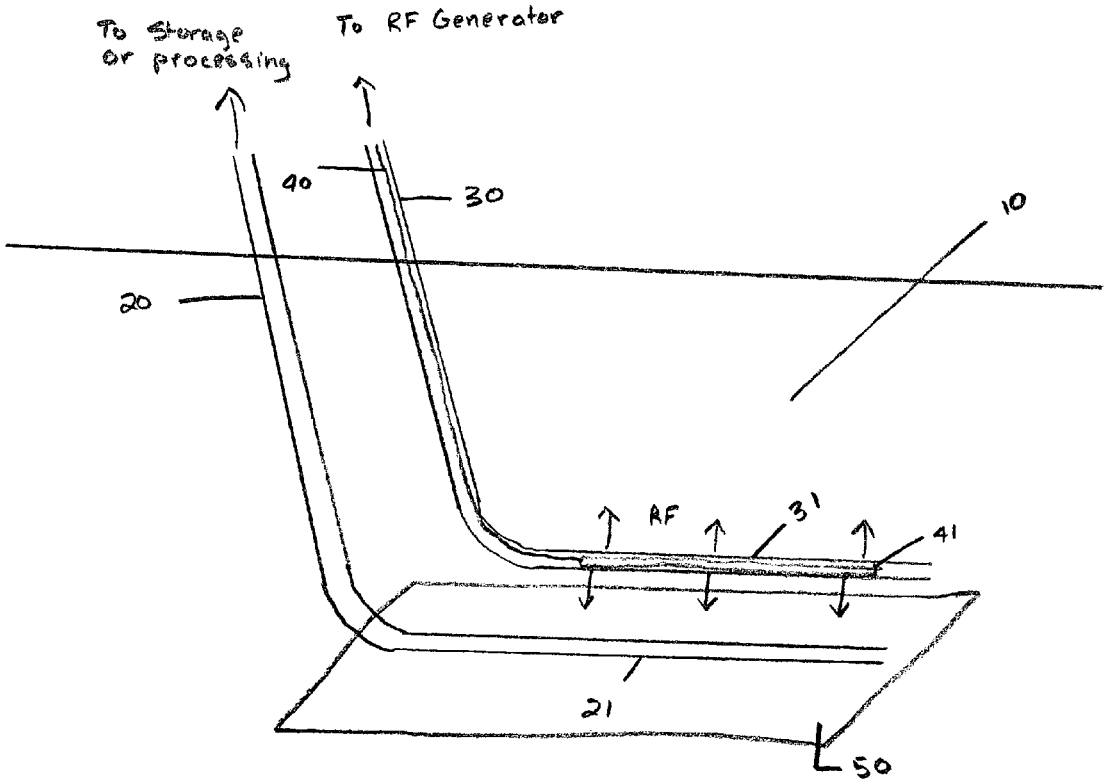
FIG. 1 is a perspective view of a basic in situ radiofrequency reactor.

FIG. 1 is a perspective view of a basic in situ radiofrequency reactor. Heavy oil is present in oil field 10. Oil/gas production well 20 is drilled into the oil field for recovery of heavy oil and other materials. At least a portion of oil/gas production well 20 is drilled horizontally through the oil field. Horizontal oil/gas production well 21 is positioned to receive oil and other gas that are moved or generated by the action of the radiofrequency reactor. A second well, radiofrequency well 30, is drilled into the oil field in proximity to oil/gas production well 20. At least a portion of radiofrequency well 30 is drilled horizontally through the oil field in proximity to and above horizontal oil/gas production well 21. Horizontal radiofrequency well 31 is used to apply radiofrequency energy to the surrounding heavy crude oil field, thereby heating the oil and reducing its viscosity. Due to gravity, the reduced heated heavy crude oil drains, where it may be captured by and pumped out through oil/gas production well 20 to storage or processing equipment.

Radiofrequency energy is generated by a radiofrequency generator. It is transmitted via radiofrequency transmission line 40 through radiofrequency well 30 and horizontal radiofrequency well 31 to radiofrequency antenna 41. Radiofrequency antenna 41 applies radiofrequency energy to the surrounding heavy crude oil, thereby heating it and reducing its viscosity so that it may be collected by and recovered through oil/gas production well 20. The oil/gas production well 20 may also act as a parasitic antenna to redirect radiation in an upward direction toward the formation to be heated by the radiofrequency energy, thereby increasing efficiency.

For purposes of in situ processing and upgrading of the heavy crude oil, horizontal oil/gas production well 21 may be embedded in catalytic bed 50. Horizontal radiofrequency well 31 may be strongly electromagnetically coupled to horizontal oil/gas producing well 21 so that the temperature of horizontal oil/gas producing well 21 may be precisely controlled, thereby allowing for upgrading of the heavy oil in horizontal oil/gas production well 21 over a wide range of temperatures. The upgrading can be based on several different known technologies, such as visbreaking, coking, aquathermolysis, or catalytic bed reactor technology.

Figure 2:
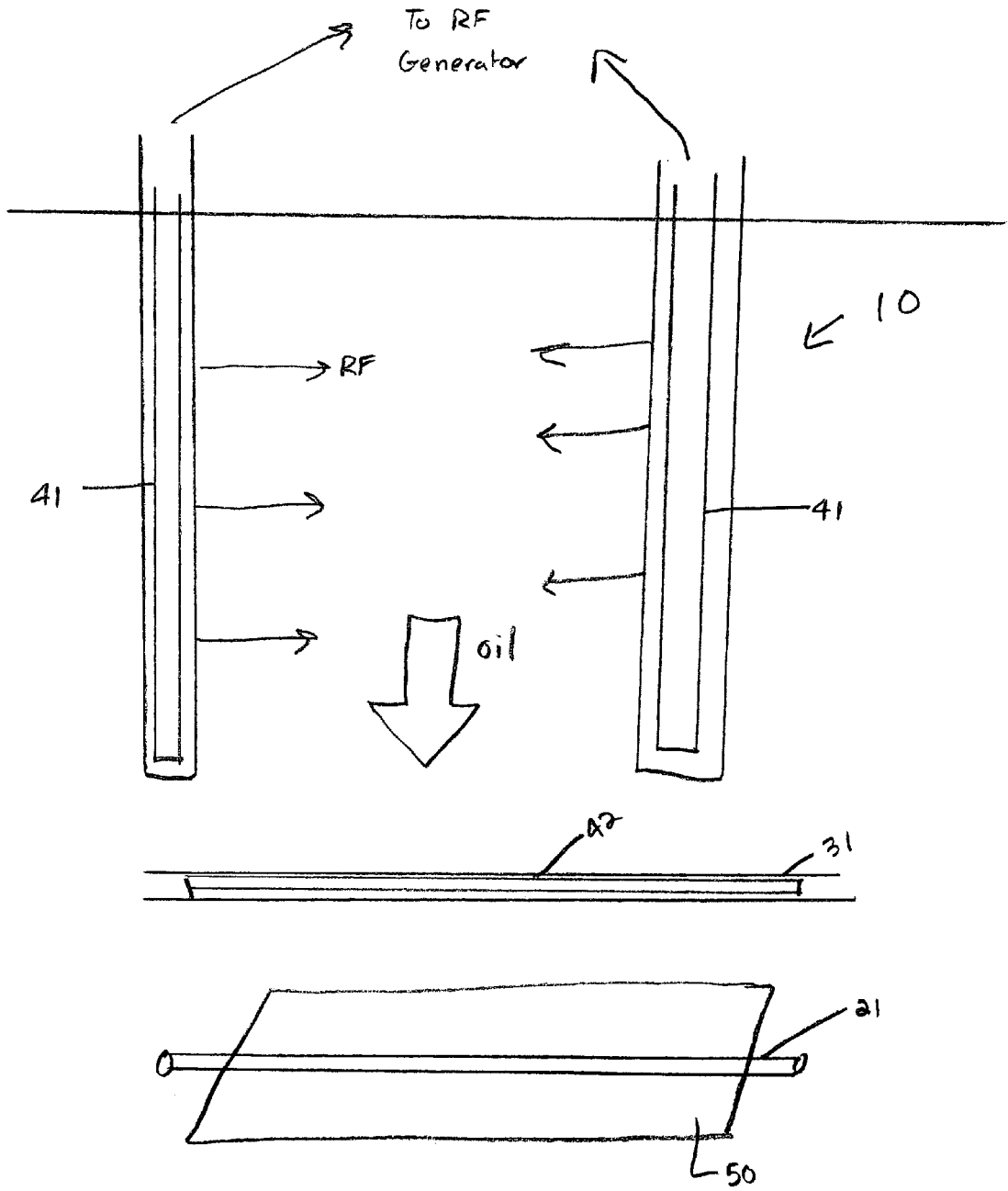
FIG. 2 is a perspective view of an alternative arrangement of an in situ radiofrequency reactor.

Radiofrequency antennae may be placed in an oil field in numerous configurations to maximize oil recovery and efficiency. FIG. 2 shows a perspective view of an alternative arrangement of an in situ radiofrequency reactor. Radiofrequency antennae 41 may be placed in proximity to one another in oil field 10. Radiofrequency energy is supplied to the antennae 41 by a radiofrequency generator and then applied to the oil field 10. The resulting heating reduces the viscosity of the oil, which drains due to gravity. Horizontal oil/gas production well 21 is positioned below the antennae 41 to collect and recover the heated oil.

As with the RFR in FIG. 1, this arrangement may also be used to process the heavy oil in situ. A horizontal radiofrequency well 31 with horizontal radiofrequency antenna 42 may be placed in proximity to horizontal oil/gas producing well 21 below antennae 41 to control the temperature of the oil. Horizontal oil/gas production well 21 may be embedded in catalytic bed reactor 50. The oil may thereby be upgraded in situ.

Figure 3:
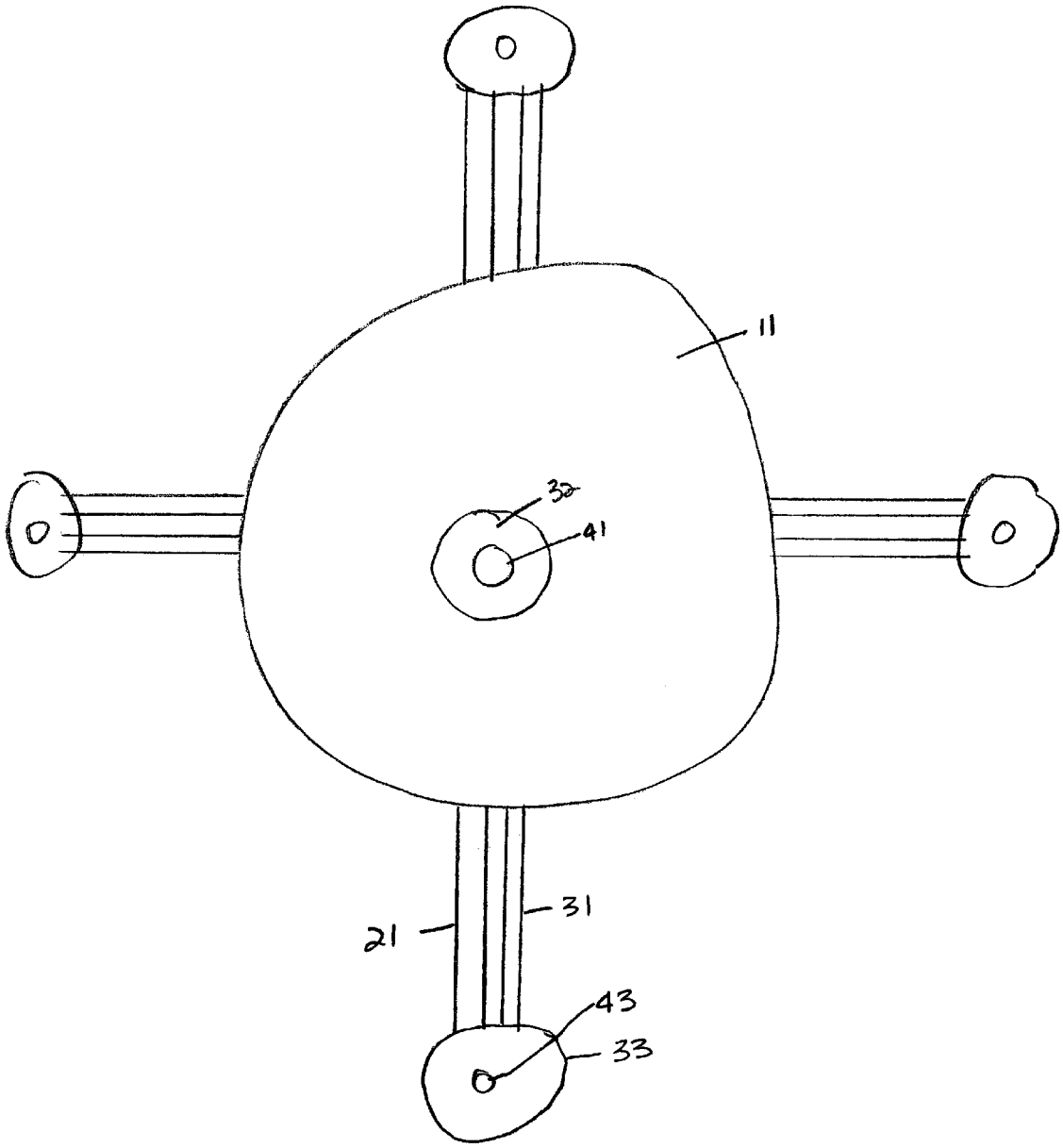
FIG. 3 is a top view of an arrangement for an in situ radiofrequency reactor for use in large oil fields.

FIG. 3 shows a top view of another arrangement for an in situ radiofrequency reactor for use in large oil fields. In this radial configuration, one central and vertical radiofrequency heating well 32 with radiofrequency antenna 41 is used for larger volumes of oil. Radiofrequency antenna 41 applies radiofrequency energy to area 11, thereby heating the oil in that area. The heated oil drains to horizontal oil/gas production wells 21 for collection and recovery. Parallel horizontal radiofrequency wells 31 may also be used to heat the oil. In addition, radiofrequency antennae 43 may be placed in vertical radiofrequency wells 33 to assist with in situ upgrading of the heavy crude oil.

Figure 4:
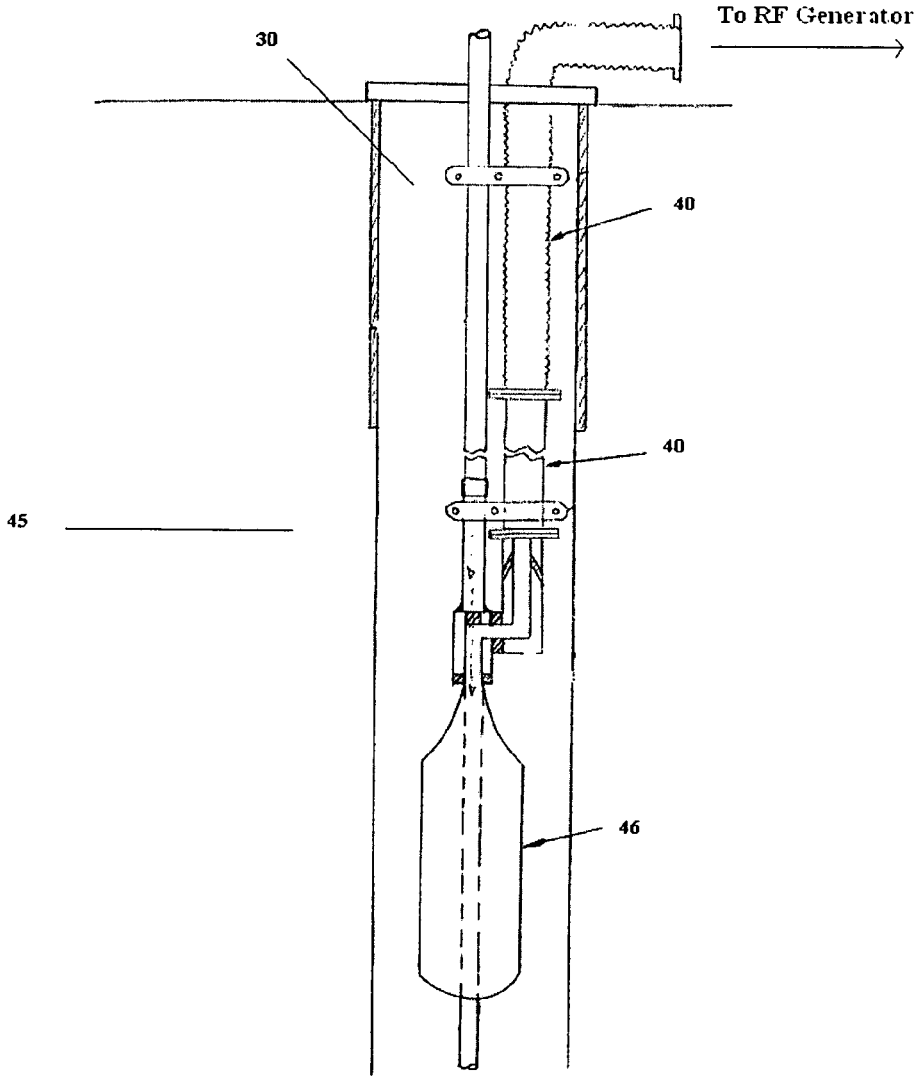
FIG. 4 is a perspective view of a single borehole radiation type applicator that may be used in the radiofrequency reactor of the present invention.

The radiofrequency antennae used in the RFR system of the present invention may be any of those known in the art. FIG. 4 shows a perspective view of a radiofrequency applicator that may be used with the RFR of the invention. Applicator system 45 is positioned within radiofrequency well 30. Applicator system 45 is then used to apply electromagnetic energy to heavy crude oil in the vicinity of radiofrequency well 30.

Applicator structure 46 is a transmission line retort. Radiofrequency energy is supplied to applicator 46 by an RF generator (not shown). The radiofrequency generator is connected to applicator 46 via radiofrequency transmission line 40. The radiofrequency transmission line 40 may or may not be supported by ceramic beads, which are desirable at higher temperatures. By this means, the radiofrequency generator supplies radiofrequency energy to applicator 46, which in turn applies radiofrequency energy to the target volume of oil.

Although one specific examples of an applicator structure is given, it is understood that other arrangements known in the art could be used as well. Uniform heating may be achieved using antenna array techniques, such as those disclosed in U.S. Pat. No. 5,065,819.

The present invention also has application in oil shale fields, such as those present in the Western United States. Large oil molecules that exist in such oil shale have been heated in a series of experiments to evaluate the dielectric frequency response with temperature. The response at low temperatures is always dictated by the connate water until this water is removed as a vapor. Following the water vapor state, the minerals control the degree of energy absorption until temperatures of about 300-350 degrees centigrade are reached. In this temperature range, the radiofrequency energy begins to be preferentially absorbed by the heavy oil. The onset of this selective absorption is rapid and requires power control to insure that excessive temperatures with attendant coking do not occur.

Because of the high temperature selective energy absorption capability of heavy oil, it is therefore possible to very carefully control the bulk temperature of crude oil heated by radiofrequency energy. The energy requirement is minimized once the connate water is removed by steaming. It takes much less energy to reach mild cracking temperatures with radiofrequency energy than any other thermal means.

Kasevich has published a molecular theory that relates to the specific heating of heavy of oil molecules. He found that by comparing cable insulating oils with kerogen (oil) from oil shale, a statistical distribution of relaxation times in the kerogen dielectric gave the best theoretical description of how radiofrequency energy is absorbed in oil through dielectric properties. With higher temperatures and lowering of potential energy barriers within the molecular complex a rapid rise in selective energy absorption occurs.

In use, a user of an embodiment of the present invention would drill oil/gas production wells and radiofrequency wells into a heavy crude oil field. At least a portion of the wells would be horizontal. The radiofrequency wells would be placed in proximity to and above the oil/gas production wells. The user would install a radiofrequency antenna in each radiofrequency well and supply such antennae with radiofrequency energy from a radiofrequency generator via a radiofrequency transmission cable. The user would then apply radiofrequency energy using the radiofrequency generator to the antenna, thereby applying the radiofrequency energy to the heavy crude oil in situ. The radiofrequency energy would be controlled to minimize coking and achieve the desired cracking and upgrading of the heavy crude oil. The resulting products would then be recovered via the oil/gas production well and transferred to a storage or processing facility.

Although the present invention has been described with reference to preferred embodiments, persons skilled in the art will recognize that changes may be made in form and detail without departing from the spirit and scope of the invention.

What is claimed is:

1. An in situ radiofrequency reactor for use in thermally recovering oil and related materials, the reactor comprising:

at least one radiofrequency heating well in an area in which crude oil exists in the ground;

a radiofrequency antenna positioned within each radiofrequency heating well in the vicinity of the crude oil;

a cable attached to each radiofrequency antenna to supply radiofrequency energy to such radiofrequency antenna;

a radiofrequency generator attached to the cables to generate radiofrequency energy to be supplied to each radiofrequency antenna, the radiofrequency generator operable to control the radiofrequency energy applied to the crude oil in order to refine the crude oil in situ; and at least one production well in proximity to and below the radiofrequency wells for the collection and recovery of crude oil.

2. The in situ radiofrequency reactor of claim 1 wherein the radiofrequency antenna is a solenoid antenna.

3. The in situ radiofrequency reactor of claim 1 wherein the radiofrequency antenna is a helical antenna.

4. An in situ radiofrequency reactor for use in thermally recovering oil and related materials and refining heavy crude oil in situ, the reactor comprising:

at least one radiofrequency heating well in an area in which crude oil exists in the ground;

a radiofrequency antenna positioned within each radiofrequency heating well in the vicinity of the crude oil;

a cable attached to each radiofrequency antenna to supply radiofrequency energy to such radiofrequency antenna;

a radiofrequency generator attached to the cables to generate radiofrequency energy to be supplied to each radiofrequency antenna, the radiofrequency generator operable to control the radiofrequency energy applied to the crude oil in order to refine the crude oil in situ;

at least one production well in proximity to and below the radiofrequency wells and coupled magnetically to the radiofrequency wells for the collection and recovery of crude oil; and at least one catalytic bed in which the production well is embedded.

5. The in situ radiofrequency reactor of claim 4 wherein the catalytic bed contains a dielectric powder to achieve efficient heating of the catalytic material.

6. A method for recovering heavy crude oil, the method comprising the steps of:

positioning a radiofrequency antenna in a well in the vicinity of heavy crude oil;

generating radiofrequency energy;

applying the radiofrequency energy to the heavy crude oil with the radiofrequency antenna to heat the oil;

recovering the heavy crude oil through production well; and controlling the radiofrequency energy applied to the heavy crude oil in order to refine the heavy crude oil in situ.

7. The method of claim 6, in which the radiofrequency energy is controlled by controlling the frequency.

8. The method of claim 7 wherein the method of refining the heavy crude oil is visbreaking.

9. The method of claim 7 wherein the method of refining the heavy crude oil is aquathermolysis.

10. The method of claim 7 wherein the method of refining the heavy crude oil is cracking.

11. The method of claim 7 wherein the method of refining the heavy crude oil is hydroprocessing.

12. The method of claim 7 wherein the method of refining the heavy crude oil uses solvents.

13. The method of claim 7 wherein the method of refining the heavy crude oil is combustion.

14. The method of claim 6, in which the radiofrequency energy is controlled by controlling the power.

15. The method of claim 14 wherein the method of refining the heavy crude oil is visbreaking.

16. The method of claim 14 wherein the method of refining the heavy crude oil is aquathermolysis.

17. The method of claim 14 wherein the method of refining the heavy crude oil is cracking.

18. The method of claim 14 wherein the method of refining the heavy crude oil is hydroprocessing.

19. The method of claim 14 wherein the method of refining the heavy crude oil uses solvents.

20. The method of claim 14 wherein the method of refining the heavy crude oil is combustion.

21. The method of claim 6, in which the radiofrequency energy is controlled by controlling the waveform.

22. The method of claim 6, in which the radiofrequency energy is controlled by controlling the modulation.

23. The method of claim 6, in which the radiofrequency energy is controlled by controlling the heating rate.

24. The method of claim 6 wherein the method of refining the heavy crude oil is visbreaking.

25. The method of claim 6 wherein the method of refining the heavy crude oil is aquathermolysis.

26. The method of claim 6 wherein the method of refining the heavy crude oil is cracking.

27. The method of claim 6 wherein the method of refining the heavy crude oil is hydroprocessing.

28. The method of claim 6 wherein the method of refining the heavy crude oil uses solvents.

29. The method of claim 6 wherein the method of refining the heavy crude oil is combustion.

* * * * *